US006666424B2

(12) United States Patent
Richardson

(10) Patent No.: US 6,666,424 B2
(45) Date of Patent: Dec. 23, 2003

(54) PORTABLE WRITING BOARD STRUCTURE

(75) Inventor: James C. Richardson, Sharpsville, IN (US)

(73) Assignee: Richardson Distribution Systems, Inc., Sharpsville, IN (US)

( * ) Notice: Subject to any disclaimer, the term of this patent is extended or adjusted under 35 U.S.C. 154(b) by 0 days.

(21) Appl. No.: 10/349,687

(22) Filed: Jan. 23, 2003

(65) Prior Publication Data

US 2003/0106979 A1 Jun. 12, 2003

Related U.S. Application Data

(63) Continuation of application No. 09/835,061, filed on Apr. 13, 2001, now abandoned.

(51) Int. Cl.[7] ..... A47B 97/04

(52) U.S. Cl. ..... 248/460; 248/463; 248/447; 248/465

(58) Field of Search ..... 248/461, 460, 248/447, 465, 458, 464, 463; 312/100; 40/748; 402/4, 73

(56) References Cited

U.S. PATENT DOCUMENTS

| | | | | |
|---|---|---|---|---|
| 1,086,746 A | | 2/1914 | Babbitt | |
| 2,751,271 A | | 6/1956 | Dessertenne et al. | |
| 3,540,787 A | | 11/1970 | Ford | |
| 3,938,772 A | | 2/1976 | Andrusiak | |
| 4,821,889 A | | 4/1989 | Cohen | |
| 5,067,543 A | | 11/1991 | Bove | |
| 5,265,541 A | | 11/1993 | Gordon | |
| D346,509 S | | 5/1994 | Mezoe | |
| 5,518,217 A | | 5/1996 | Deutsch et al. | |
| 5,697,595 A | * | 12/1997 | Sperber | 248/452 |
| 5,720,464 A | | 2/1998 | Meinscher et al. | |
| 6,012,786 A | | 1/2000 | Dunn | |
| 6,152,417 A | | 11/2000 | Randall | |
| 6,155,325 A | | 12/2000 | Schirer | |
| 6,170,792 B1 | | 1/2001 | Miceli et al. | |
| 6,189,594 B1 | | 2/2001 | Carter | |

FOREIGN PATENT DOCUMENTS

| | | | |
|---|---|---|---|
| FR | 2591084 | * | 12/1985 |
| GB | 2081572 | * | 5/1980 |
| GB | 2202431 A | * | 1/1988 |

* cited by examiner

*Primary Examiner*—Gwendolyn Baxter
(74) *Attorney, Agent, or Firm*—Maginot, Moore & Bowman

(57) ABSTRACT

A portable writing board presentation structure has a collapsible writing surface, such as a dry-erase or "white board" surface, and an integral, height-adjustable tripod stand. The writing board structure is defined by first and second injection molded plastic panels, each panel having a writing surface on one side thereof and a non-writing surface on an opposite side thereof. The panels are pivotally coupled to one another to define an open position and a closed position. The open position situates the writing surface in a co-planar relationship to provide a continuous writing surface. The closed position situates the writing surface sides of each panel in a parallel relationship. With respect to the tripod stand, an end section of a telescoping leg is integrally molded into each panel such that the remaining telescoping section of the telescoping leg extends into a recess formed in a non-presentation side surface of the panel.

18 Claims, 16 Drawing Sheets

PORTABLE WRITING BOARD STRUCTURE

This U.S. patent application is a continuation of and thus claims priority to U.S. patent application Ser. No. 09/835,061 filed Apr. 13, 2001, entitled Portable Display Board System, now abandoned.

FIELD OF THE INVENTION

The present invention relates generally to display boards and, more particularly, to a foldable and portable white board.

DESCRIPTION OF THE PRIOR ART

There are many types of display boards that may be used for presentations such as dry-erase or "white" boards, chalkboards, and/or the like. However, heretofore designed display boards are difficult to move from location to location. This is particularly true if the board must be carried onto an airplane or placed into an automobile. A primary reason for this is the size of a typical display board.

In view of the above, various display boards have been designed that are collapsible or foldable. To this end, these previous display boards typically have a plurality of hinged panels that can fold together in order to alleviate the size problem. Some of these display boards include a handle that allows the display board to be portable. A major drawback with these type of display boards is that they are designed for table top use only, or must be used in conjunction with an easel or the like. The easel poses another problem, namely, having to carry another piece of equipment with the display board.

Another problem with previous display boards is that there is little to no writing surface. Most previous display boards are adapted to receive pictures, charts and the like mounted thereon. When there is a writing surface, a small board or portion of a board is provided. These display boards fall short in cases where it is necessary to have a large writing area.

Yet another problem with the above-referenced display boards and other types of display boards, is that they are either too light, being made of cardboard or similar material, or are too heavy.

In view of the above shortcomings, it would thus be desirable to have a portable display board that is height adjustable using its own height adjustment mechanism.

Given the above, it would thus be further desirable to have a portable display board that has a large writing surface.

Still given the above, it would thus be even further desirable to have a display board that incorporate features that alleviates all of the above shortcomings/problems associated with previous display boards.

SUMMARY OF THE INVENTION

A portable writing board presentation structure has a collapsible writing surface, such as a dry-erase or "white board" surface, and an integral, height-adjustable tripod stand.

The writing board structure is defined by first and second injection molded plastic panels, each panel having a writing surface on one side thereof and a non-writing surface on an opposite side thereof. The panels are pivotally coupled to one another to define an open position and a closed position. The open position situates the writing surface sides of each panel in a co-planar relationship to provide a continuous writing surface. The closed position (i.e. folded or collapsed position) situates the writing surface sides of each panel in a parallel relationship to provide portability of the writing board structure in an attache-like manner. In the closed position, the plastic panels form a carrying case and thus provide a portable, protected and durable writing surface structure.

With respect to the integral, height-adjustable stand, an end section of a telescoping leg is integrally molded into each panel such that the remaining telescoping section of the telescoping leg extends into a recess formed in a non-presentation side surface of the panel. The exposed telescoping leg section thus does not breach any plane defined by the surfaces of the panel when in a stowed position. A center telescoping leg is carried at a pivot point of the panels and is restrained in outward movement relative to the panels by an integral retaining device. Extension of the telescoping legs of the panels and the center telescoping leg defines the tripod stand for the writing board structure.

In one form, the present invention is a portable writing board structure. The writing board structure includes a first injection molded plastic panel having a first side with a first writing surface portion and a second side opposite the first side, a second injection molded plastic panel having a first side with a second writing surface portion and a second side opposite the first side, the first and second injection molded plastic panels pivotally coupled to one another such that the first and second panels define a closed position and an open position, the open position situating the first and second writing surface portions in a co-planar relationship to provide a continuous writing surface, and the closed position situating the first and second writing surface portions in a parallel relationship. The writing board further includes a first telescoping leg having an end section integrally molded into the first panel such that a remaining telescoping section of the first telescoping leg extends in a first concavity formed in the second side of said first panel, a second telescoping leg having an end section integrally molded into the second panel such that a remaining telescoping section of the second telescoping leg extends into a second concavity formed in the second side of the second panel, and a center telescoping leg pivotally attached at one end to one of the first and second panels. The first, second and center telescoping legs forming a height-adjustable tripod stand for the first and second panels when the first and second panels are in the open position.

In another form, the present invention is a portable writing board structure. The writing board structure includes a first injection molded plastic panel having a first side with a first writing surface portion and a second side opposite the first side, a second injection molded plastic panel having a first side with a second writing surface portion and a second side opposite the first side, the first and second injection molded plastic panels pivotally coupled to one another such that the first and second panels define a closed position and an open position, the open position situating the first and second writing surface portions in a co-planar relationship to provide a continuous writing surface, and the closed position situating the first and second writing surface portions in a parallel relationship. The writing board further includes a first telescoping leg having an end section integrally molded into the first panel such that a remaining telescoping section of the first telescoping leg extends in a first concavity formed in the second side of said first panel, a second telescoping leg having an end section integrally molded into the second panel such that a remaining telescoping section of the second telescoping leg extends into a second concavity formed in the second side of the second panel, and a center telescoping leg pivotally attached at one end to one of the first and second panels. The structure still further provides a leg support pivotally attached to one of the first and second panels and having a clip surrounding the center telescoping leg and operative to limit outward pivoting of the center telescoping leg. The first, second and center telescoping legs forming a height-adjustable tripod stand for the first and second panels when the first and second panels are in the open position.

In yet another form, the present invention is a portable, dry erase presentation structure that includes a first injection molded plastic panel having a first side with a first dry erase writing surface portion and a second side opposite the first side, a second injection molded plastic panel having a first side with a second dry erase writing surface portion and a second side opposite the first side, the first and second injection molded plastic panels pivotally coupled to one another such that the first and second panels define a closed position and an open position, the open position situating the first and second dry erase writing surface portions in a co-planar relationship to provide a continuous dry erase writing surface, and the closed position situating the first and second dry erase writing surface portions in a parallel relationship. There is further provided a first telescoping leg having an end section integrally molded into the first panel at a first angle relative to a line parallel with the center telescoping leg and such that a remaining telescoping section of the first telescoping leg extends in a first concavity formed in the second side of the first panel, and a second telescoping leg having an end section integrally molded into the second panel at a second angle relative to the line parallel with the center telescoping leg and such that a remaining telescoping section of the second telescoping leg extends into a second concavity formed in the second side of the second panel. Moreover, there is provided a center telescoping leg pivotally attached at one end to one of the first and second panels, and a leg support pivotally attached to one of the first and second panels and having a clip surrounding the center telescoping leg and operative to limit outward pivoting of the center telescoping leg. The first, second and center telescoping legs forming a height-adjustable tripod stand for the first and second panels when the first and second panels are in the open position.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views.

DETAILED DESCRIPTION

While the invention is susceptible to various modifications and alternative forms, the specific embodiment(s) shown and/or described herein is by way of example. It should thus be appreciated that there is no intent to limit the invention to the particular form disclosed, as the intention is to cover all modifications, equivalents, and alternatives falling within the spirit and scope of the invention as defined by the appended claims.

Figure 1:
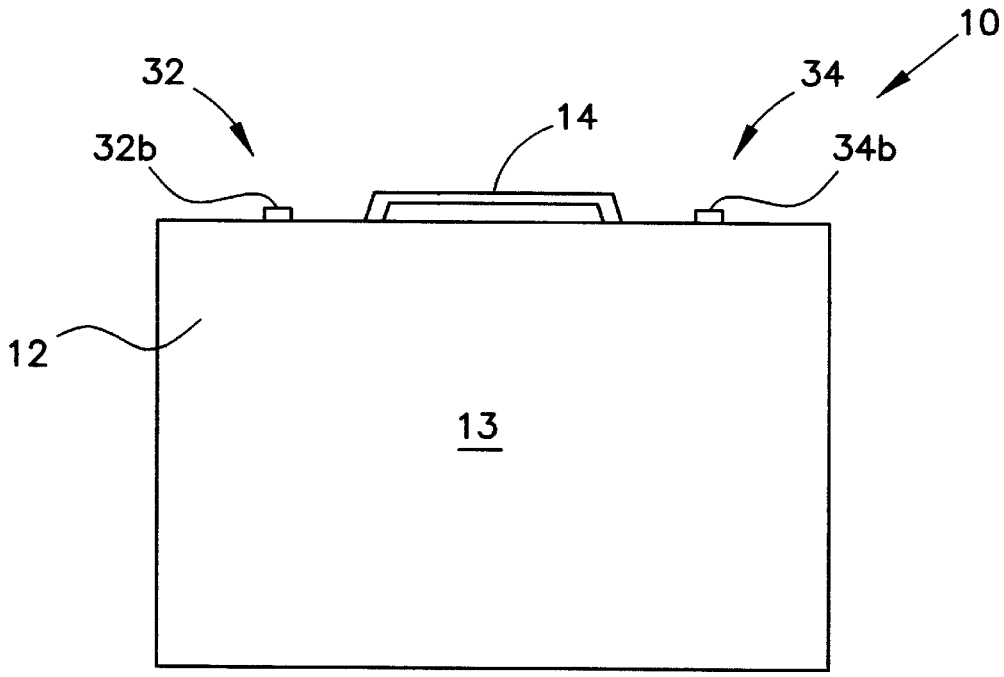
FIG. 1 is a front plan view of an embodiment of a portable display board system in accordance with the principles of the present invention in a closed, collapsed, or folded state.
Figure 2:
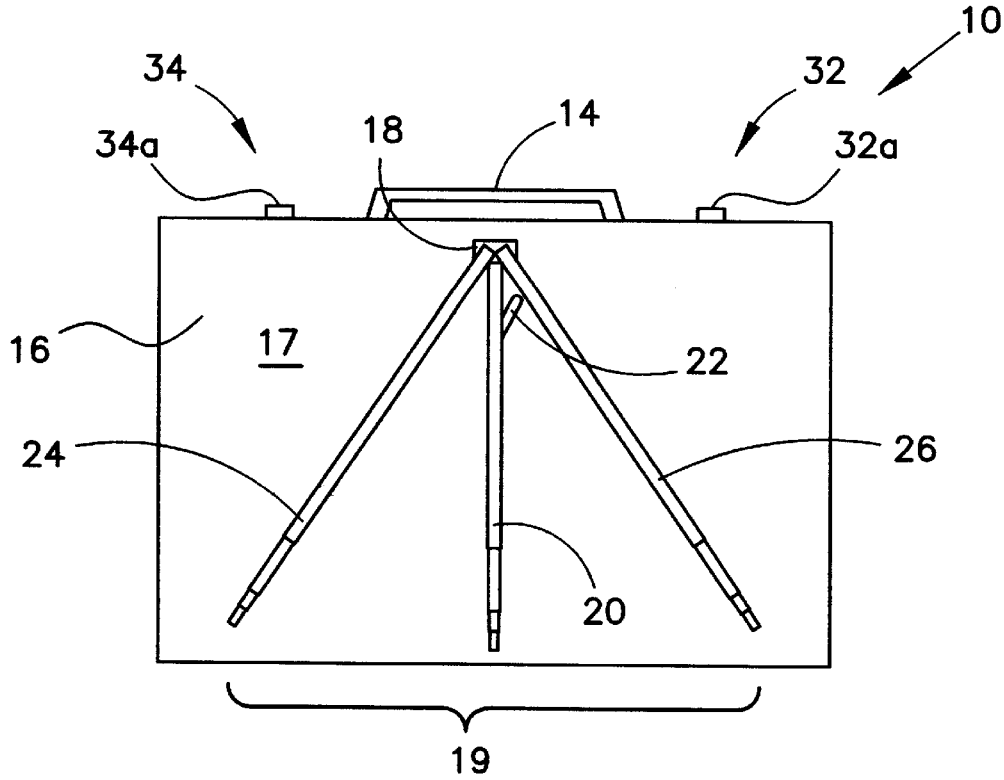
FIG. 2 is a rear plan view of the portable display board system of FIG. 1 in the closed, collapsed, or folded state.

In FIGS. 1 and 2 there is shown an exemplary embodiment of a portable display or corporate board, generally designated 10, per the principles presented herein. The portable display board 10 includes a first panel or board 12 and a second panel or board 16. The panels 12 and 16 are preferably the same size and composition, but may vary in size and/or composition. The outside surface 13 of the panel 12 may be covered with a leather, vinyl, or similar aesthetically pleasing and/or durable material, particularly to look like a briefcase or the like when the display board 10 is carried. Likewise, the outside surface 17 of the panel 16 may be preferably covered with a leather, vinyl, or similar aesthetically pleasing and/or durable material, for the same reasons as for the outside surface 13 of the panel 12.

A set of length adjustable legs 19 is provided on the outside surface 17 of the panel 16 that provide a height adjustment mechanism for the first and second panels 12 and 16. The set of length adjustable legs 19 is attached to the outside surface 17 via a bracket 18. The bracket 18 may provide for one, some or all of the legs 19 to pivot in some manner with respect to the panel 17. Pivoting may include motion away from the outside surface 17 in a perpendicular direction relative to the outside surface 17 and/or motion along the outside surface 17 in a coplanar direction relative to the outside surface 17. In the embodiment shown, three legs, 20, 24, and 26 forms the set of length adjustable legs 19, each of which is formed of a plurality of telescoping rods. The telescoping rods are length adjustable into an infinite number of selectable positions of course, other manners of adjustable legs may be used. The legs 20, 24 and 26 form a tripod with the center leg 20 operative to rotate, swing, or pivot outward from the outside surface 17, and the outside legs 24 and 26 operative to rotate, swing, or pivot along or essentially coplanar with the outside surface 17. Again, other configurations of legs that provides a stable platform for allowing the display board 10 to freely stand.

Figure 4:
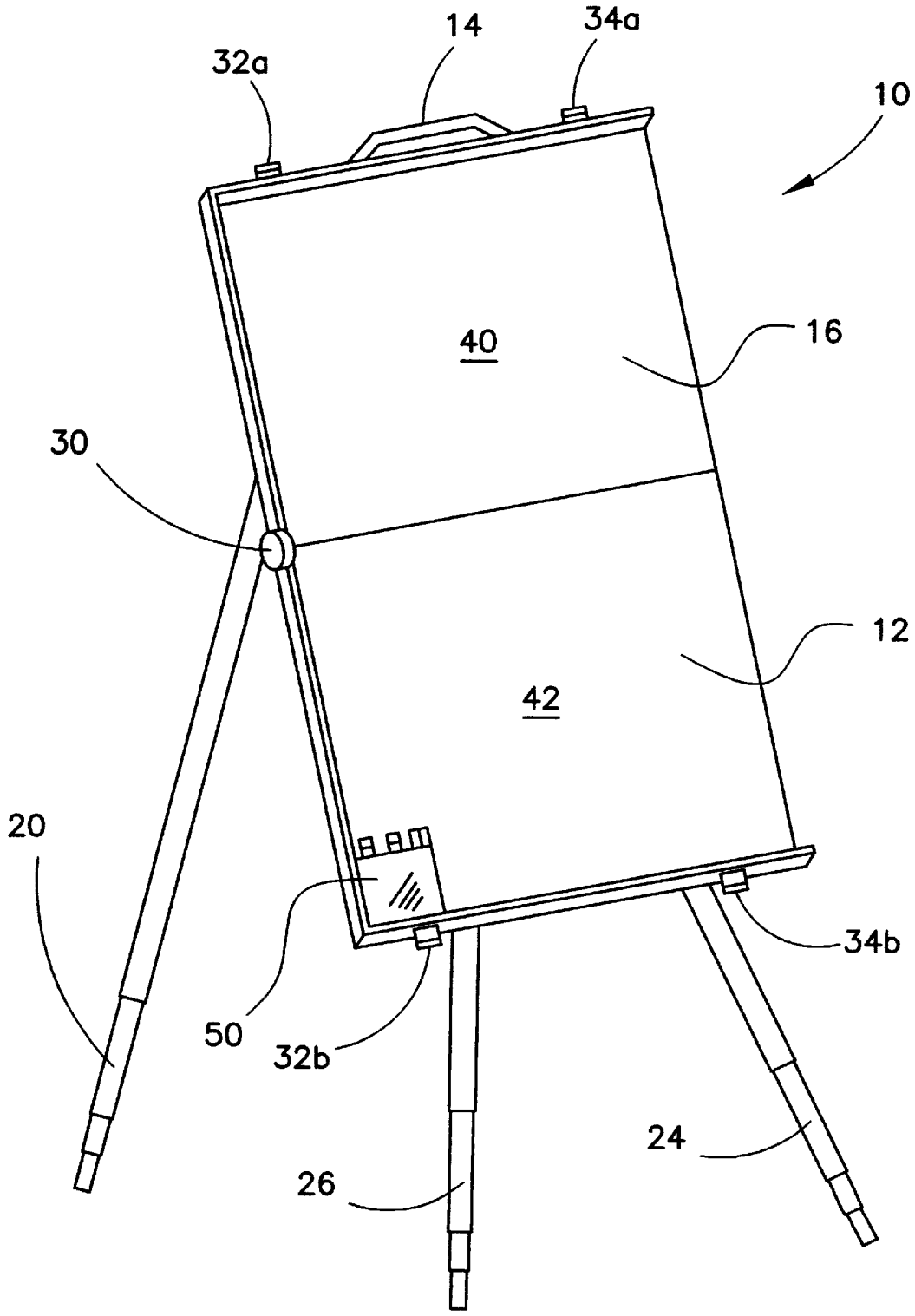
FIG. 4 is a front perspective view of the portable display board system of FIGS. 1–3 in an open and extended position.

It should be appreciated that the set of adjustable legs 19 may be formed by any number of individually adjustable legs, in any configuration, that allow the display board 10 to be free standing such as that shown in FIG. 4. As well, the legs forming the set of length adjustable legs 19 may utilize a manner of adjustment other than by interconnected, telescoping rods as indicated above. As shown in FIG. 2, it is preferable that the set of adjustable legs 19 collapse or reduce in length such that the individual legs do not extend beyond the ends or edges of the panel 16 when the display board 10 is in a carrying or transportation mode. Clamps or clips may be provided on the outside surface 17 to help retain the legs when not in use.

The display board 10 also includes a handle 14 disposed on an upper end or edge of the panel 16. It should be appreciated that while the handle 14 is shown on the panel 16, it can be disposed on an upper end or edge of the panel 12, or any edge or end of either board. The display board 10 further includes a first clasp or latch generally designated 32 having two components 32*a* and 32*b* that are disposed on the ends of the respective panels 16 and 12. The display board 10 also includes a second clasp or latch generally designated 34 having two components 34*a* and 34*b* that are disposed on the ends of the respective panels 16 and 12. It should be appreciated that there may be only one clasp or latch, that the clasp or latch may be formed by a single piece or more than two pieces, and that various types of devices are operative and contemplated to perform clasping or latching of the two panels 12 and 16 together in a face-to-face relationship. The clasp(s) aid in retaining the panels 12 and 16 together (abutting) or in a side-to-side relationship when the display board is in a collapsed or folded state as depicted in FIGS. 1–3.

Figure 3:
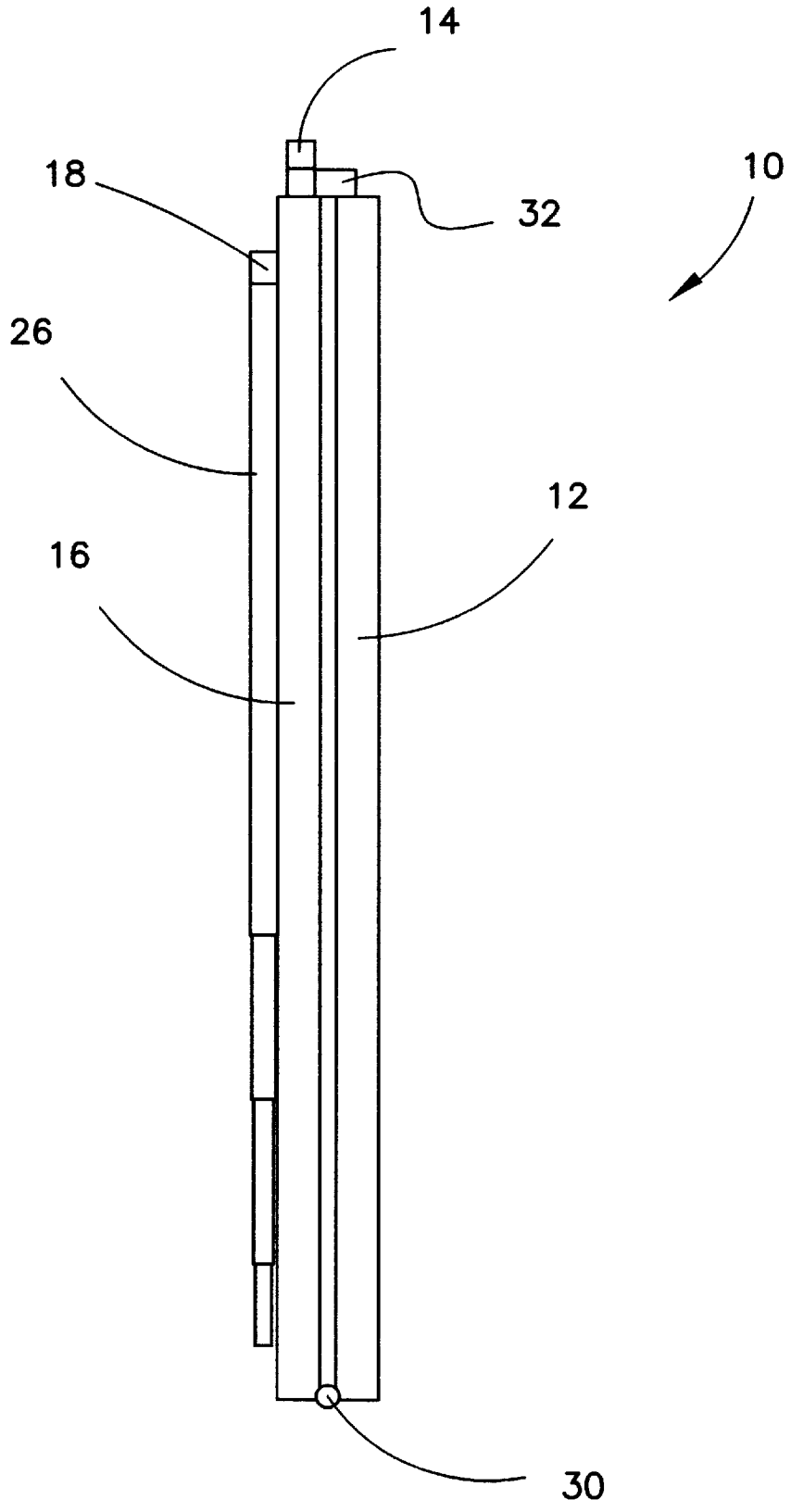
FIG. 3 is a side plan view of the portable display board system of FIGS. 1 and 2 in the closed, collapsed, or folded state.

To this end, the panels 12 and 16 are joined or attached to one another at complementary ends thereof, as best seen in FIG. 3, in a manner that allows the panels 12 and 16 to move, swing, or pivot relative to one another. Referring to FIG. 3, the panels 12 and 16 may be attached via a hinge 30 or other device that allows the panels 12 and 16 to pivot or move relative to the other. In particular, the panels 12 and 16 are attached to one another such that the panels 12 and 16 define and are movable between an extended/opened position and a collapsed/folded position. In FIGS. 1–3, the display board 10 is shown in a folded, collapsed, or carrying position or state.

Figure 5:
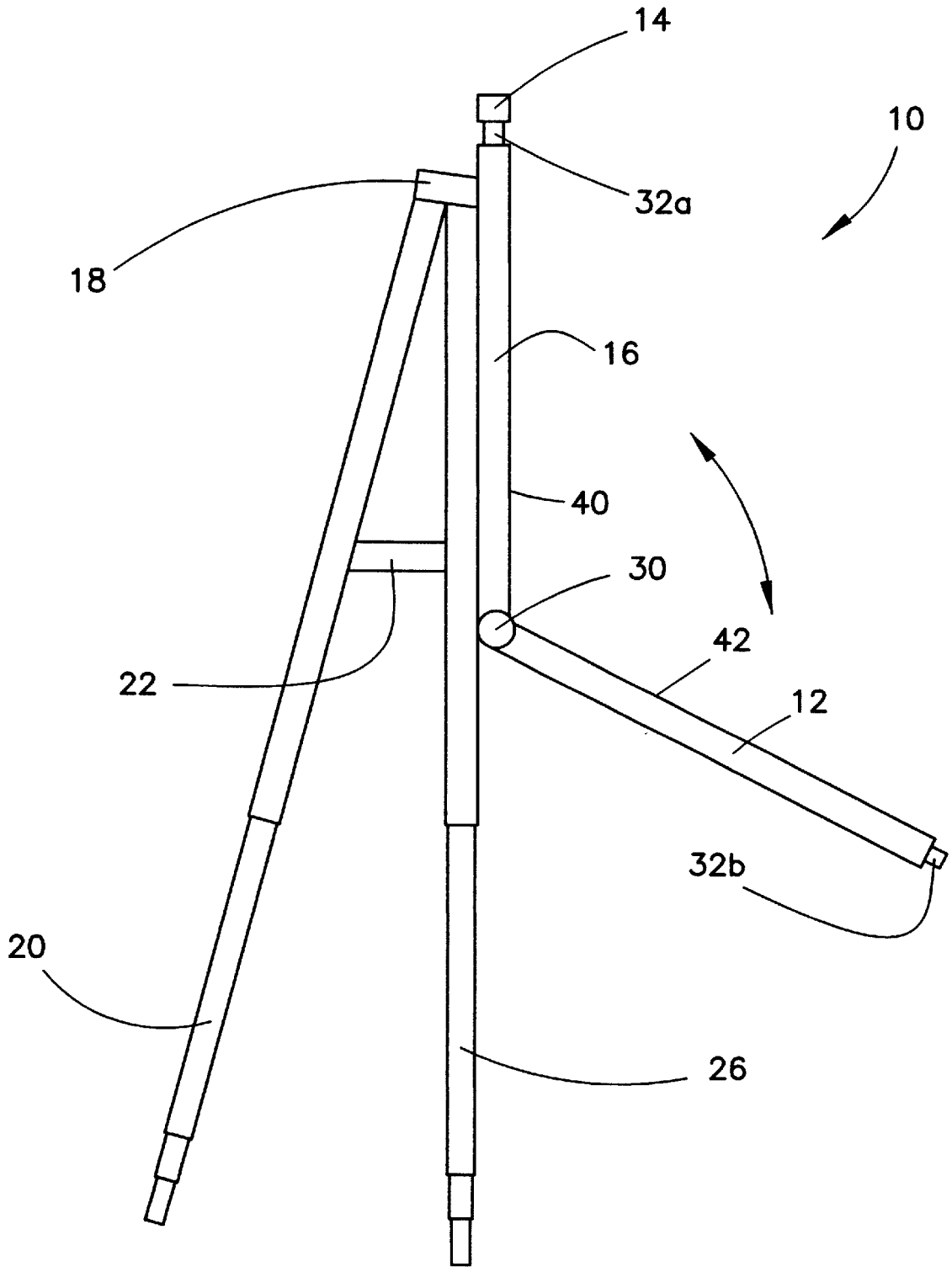
FIG. 5 is a side view of the portable display board system of FIGS. 1–4 illustrating the manner in which the display board extends.

In FIG. 5, the legs 20, 26, and 24 (not seen) are extended in a tripod configuration with an extension 22 extending from the leg 20 and the outside surface 17 for support, such that the display board 10 may freely stand and the panels 12 and 16 may be opened. In FIG. 5, the panels 12 and 16 are shown being opened from the closed or collapsed position (as in FIGS. 1–3) as represented by the two-headed arrow, into a fully open position (see FIG. 4).

In FIG. 4, the portable display board 10 is shown in a fully open and extended position. In particular, the legs 24 and 26 are extended downwardly a given distance to set the height of the panels 12 and 16, while the hinged/middle leg 20 is likewise extended downwardly a given distance and pivoted outwardly to form the tripod. The panel 16 also defines a presentation side or surface 40 that are opposite the outside surface 17, while the panel 12 also defines a presentation side or surface 42 that is opposite the outside surface 13. The presentation sides may comprise a writing surface such as a "white" or dry-erase board, a chalkboard, or any other type of surface on which one may write and, preferably, erase. The presentation sides may be magnetic and/or may alternatively comprise another type of display and/or presentation surface.

When the panel 12 is pivoted downward such that the writing surface 42 is exposed, the writing surface 40 of the panel 16 is also exposed. In particular, an edge of the panel 12 that is attached to the hinge 30 and the edge of the panel 16 that is attached to the hinge 30 abuts one another such that the writing surfaces 40 and 42 form a continuous or contiguous presentation and/or writing surface. In this manner, the presentation or writing surface is doubled over conventional "one-panel" devices.

Because the stand (i.e. the set of adjustable legs 19) of the display board 10 is integral with or attached to the panel 16, the handle 14 can not only be used to transport the display board 10 when it is in a folded or collapsed state or position as in FIGS. 1–3, but can be used to carry the display board 10 when it is in an open or extended state or position as in FIG. 4.

FIG. 4 also shows an optional supply holder 50 formed as a pouch or pocket. The holder 50 holds several markers, erasers, and the like (collectively, "board tools") for writing on the writing surfaces 40 and 42 of boards 16 and 12. The pocket 50 is designed to hold the board tools even when the display board 10 is in the folded or collapsed state ready for transporting or carrying.

Figure 6:
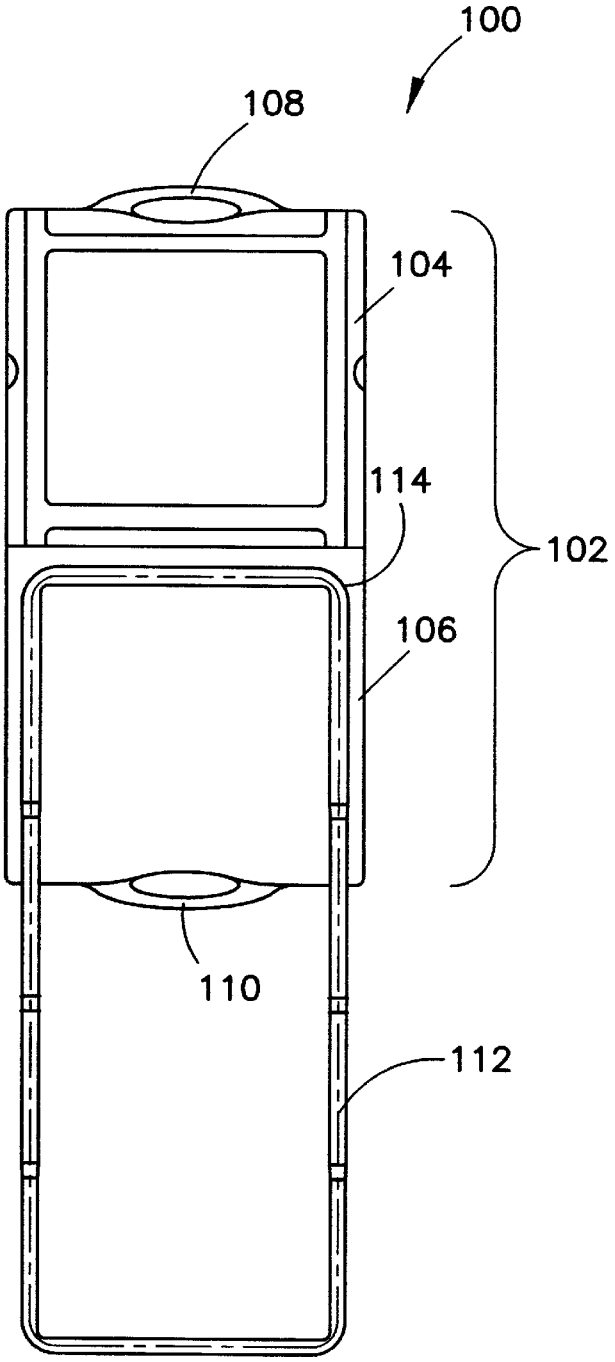
FIG. 6 is a rear plan view of another embodiment of the present portable display board showing one set of extendable legs in an extended position and the board in an open position.

Referring now to FIG. 6, there is shown another embodiment of the present portable display or corporate board, generally designated 100. The display board 100 is a modular version that is preferably manufactured from plastic such as an injection-molded plastic. In particular, the display board 100 includes a body 102 defined by a first panel 104 and a second panel 106, here shown in an open position with the rears thereof facing outward. The first panel 104 includes a handle portion 108 that is integral therewith. The second panel 106 includes a handle portion 110 that is integral herewith. The handle portions 108 and 110 cooperate when the first and second panels 104, 106are in a closed position to provide an integral carrying handle for the display board 100.

Figure 7:
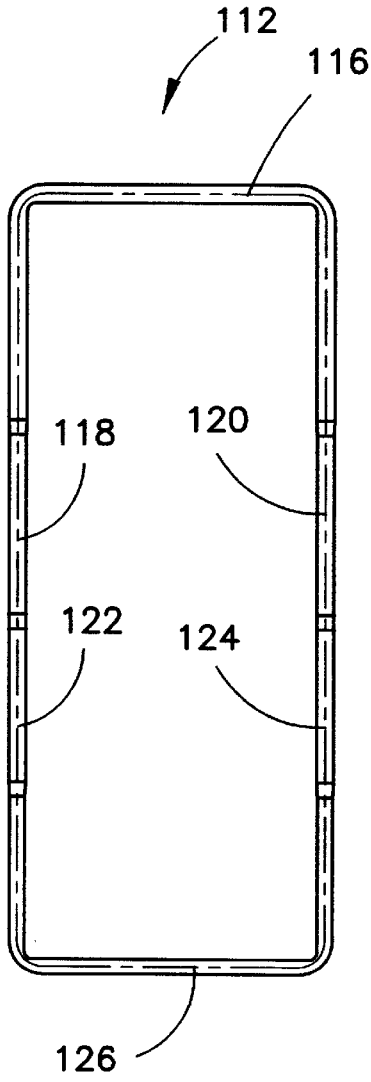
FIG. 7 is a plan view of the one set of extendable legs.

The display board 100 further includes an extendable stand 112 that is partially seated in a channel 114 in the second panel 106. Referring additionally to FIG. 7, the extendable stand 112 is formed of a first U-shaped rod or member 116 that is disposed in the channel 114. A rod 118 of a slightly smaller diameter than the U-shaped rod 116 is disposed in one "arm" of the U-shaped rod 116 such that the rod 118 can slide or telescope into the arm of the U-shaped rod 116. A rod 122 of a slightly smaller diameter than the rod 118 is disposed in the rod 118. The rod 122 can thus slide or telescope into the rod 118. In like manner, a rod 120 of a slightly smaller diameter than the U-shaped rod 116 is disposed in another "arm" of the U-shaped rod 116 such that the rod 120 can slide or telescope into the arm of the U-shaped rod 116. A rod 124 of a slightly smaller diameter than the rod 120 is disposed in the rod 120. The rod 124 can thus slide or telescope into the rod 120. Further, a second U-shaped rod or member 126 has first and second arms of a smaller diameter than rods 122 and 124 that fit into the rods 122 and 124 such that the U-shaped rod 126 can slide or telescope into the rods 122 and 124. The U-shaped rod 126 provides a support surface for the display board 100 and is pivotal with respect to the panel 106.

While not specifically shown in FIGS. 6 and 7, the display board 100 preferably includes a second extendable stand (see FIGS. 14–16) that is substantially the same in configuration and operation as the first extendable stand 112. The second extendable stand fits into and is retained by the first panel 104 in the same manner as the first extendable stand 112 fits into and is retained by the second panel 106.

Figure 8:
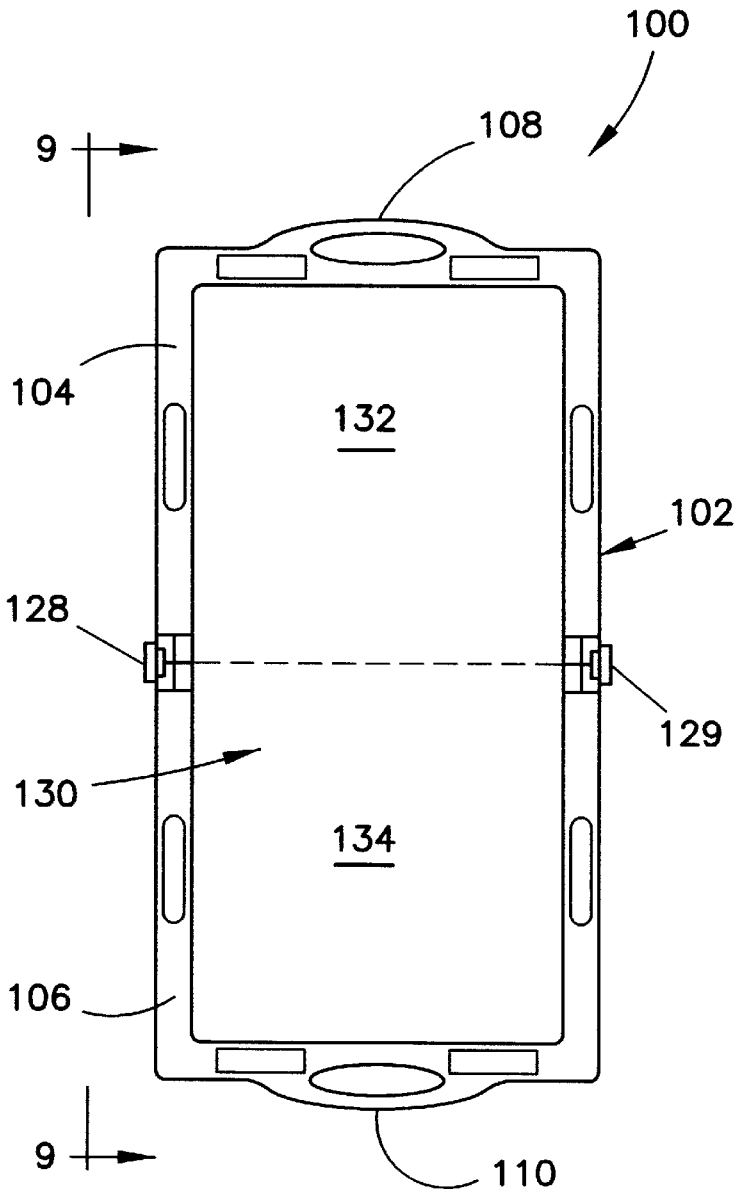
FIG. 8 is a front plan view of the embodiment of FIG. 6, with the board in an open position but no legs extended.
Figure 9:
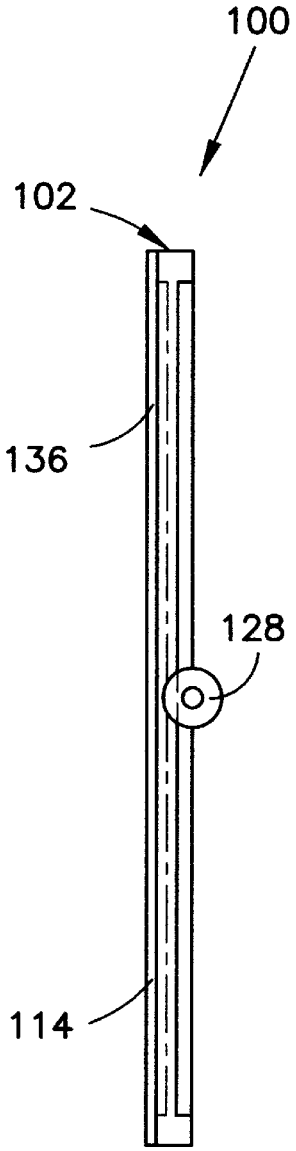
FIG. 9 is a side view of the present portable display board taken along line 9—9 of FIG. 8.
Figure 10:
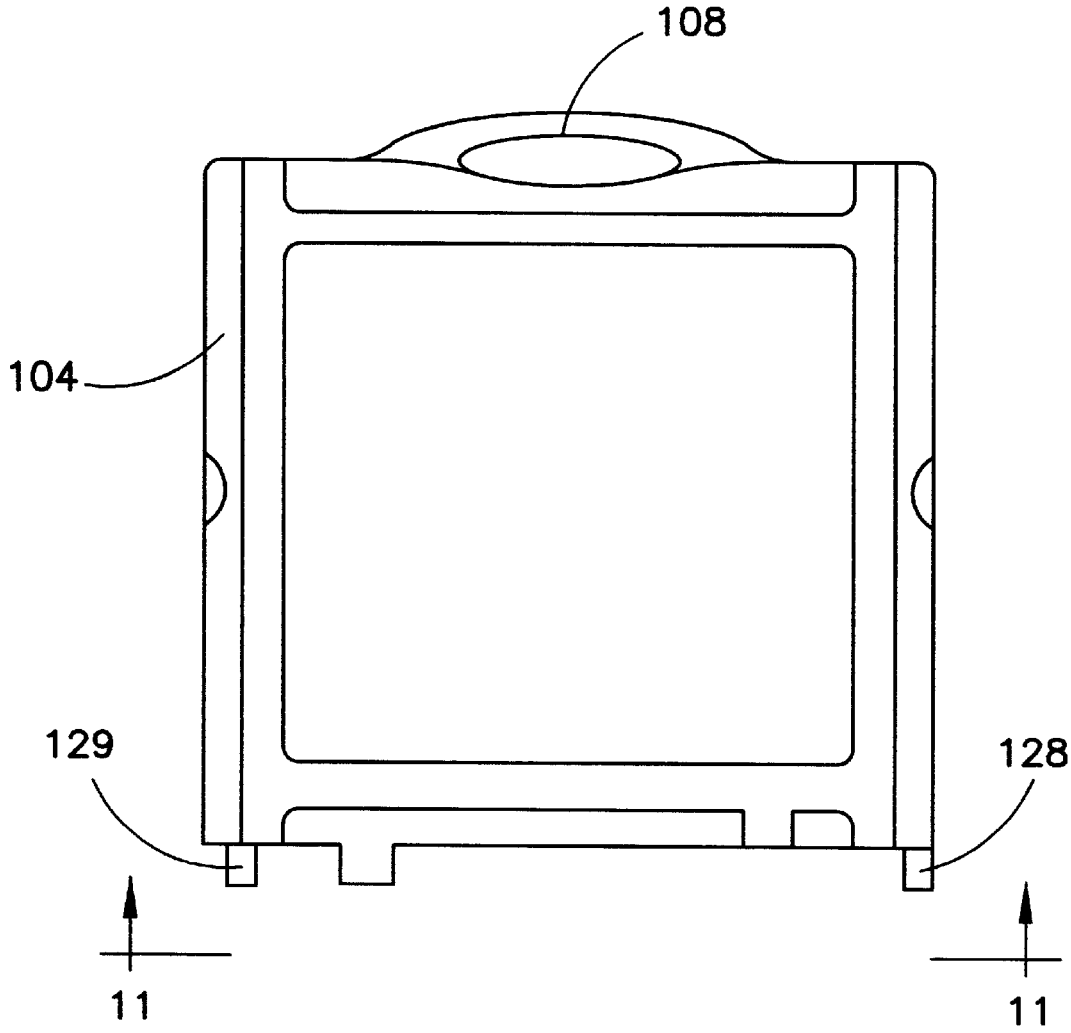
FIG. 10 is a plan view of an outside surface of one panel of the portable display board of FIG. 6.
Figure 11:
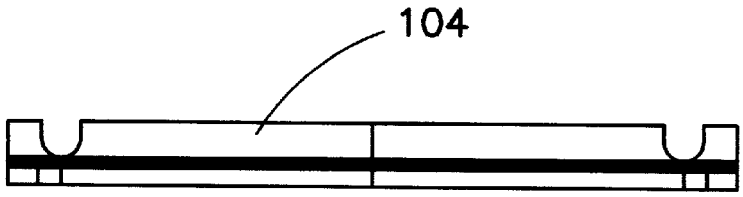
FIG. 11 is a side view of the panel of FIG. 10 taken along line 11—11 of FIG. 10.
Figure 13:
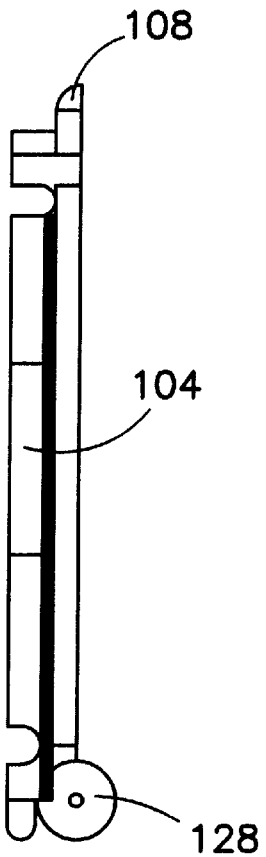
FIG. 13 is a side view of the portable display board of FIG. 12 taken along line 13—13 of FIG. 12.
Figure 12:
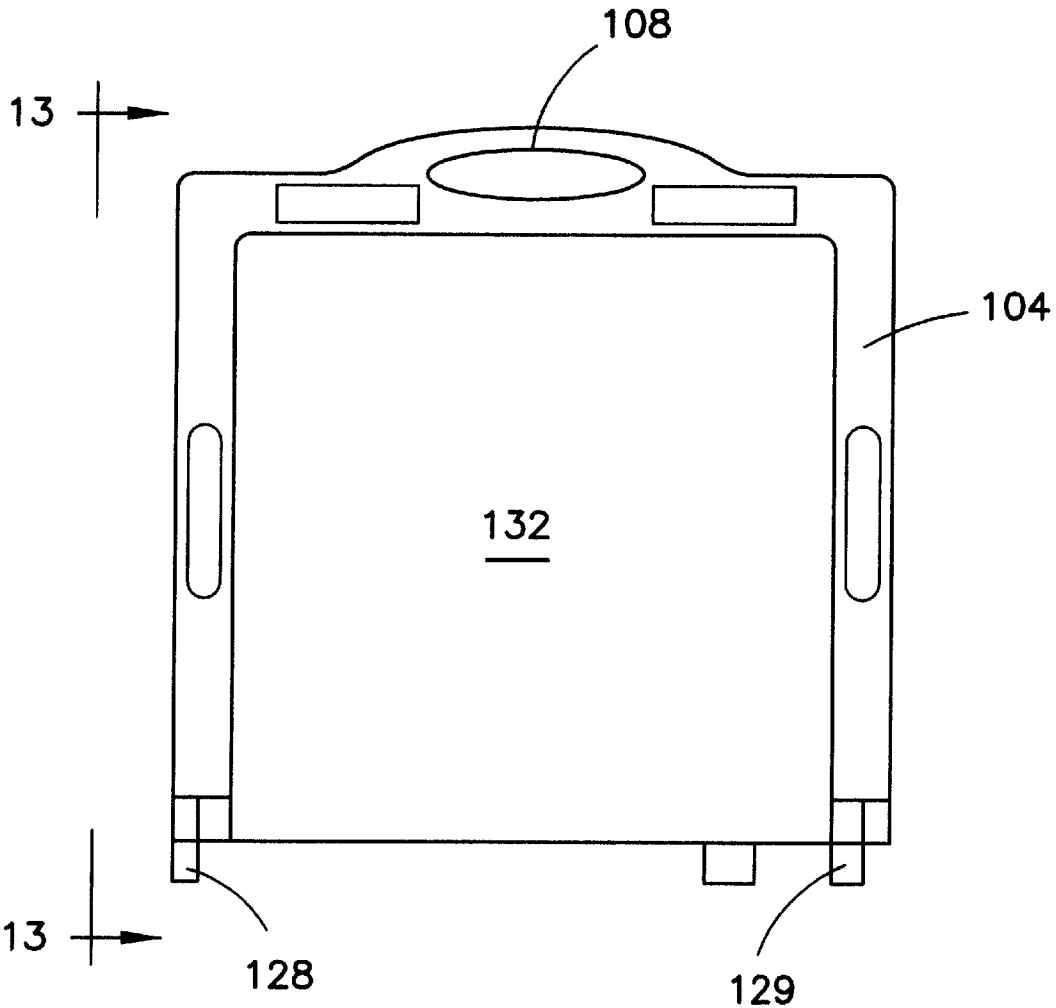
FIG. 12 is a plan view of an inside surface of the panel of the portable display board of FIG. 10.

In FIGS. 8 and 9 the display board 100 is shown in an open position. The first panel 102 includes a writing or display surface 132, while the second panel 106 includes a writing or display surface 134. Together, the writing surfaces 132 and 134 define a contiguous and/or continuous writing surface 130 that is integral with or part of the body 102. The first panel 104 and the second panel 106 are pivotally coupled to one another via hinges 128 and 129 such that the panels 104 and 106 can selectively be in a first or open position as depicted in FIG. 8, or in a second or closed position wherein the writing surfaces 132 and 134 are abutting. As best seen in FIG. 9, the first panel 104 includes a channel 136 for the second extendable stand (not shown).

Referring to FIGS. 10–13, there is shown the first panel 104. The first panel 104 is preferably made of a suitable plastic such as an injection-molded plastic, or any other suitable material. The writing surface 132 is preferably a dry or wet erase marker type board, a "white" board, chalkboard, and/or any other suitable surface for writing on and, preferably erasing.

Figure 14:
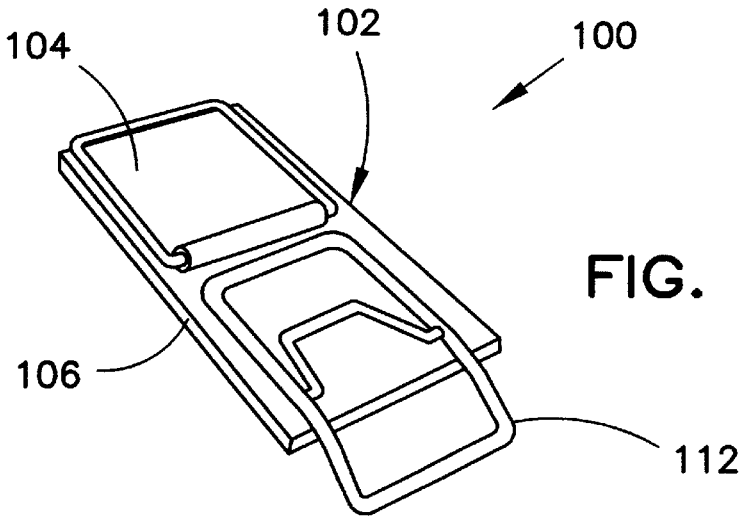
FIG. 14 is a bottom perspective view of the portable display board of FIG. 6 with the extendable legs in a closed or collapsed position.
Figure 15:
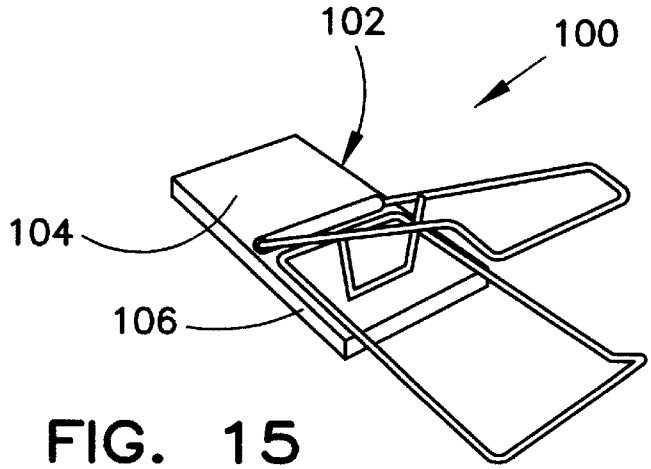
FIG. 15 is a bottom perspective view of the portable display board of FIG. 6 with the extendable legs in an extended position.
Figure 16:
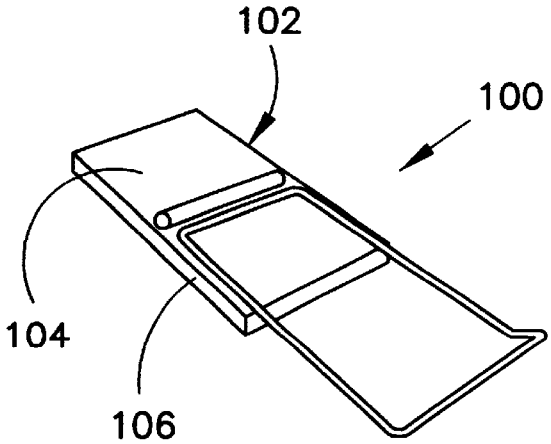
FIG. 16 is a bottom perspective view of the portable display board of FIG. 6 with the extendable legs in an extended and open position.

FIGS. 14–16 shows the rear of the display board 100, with the body 102 in an open position. It should be appreciated that the display board 100 is also moveable into a closed position wherein the panels 104 and 106 close on or abut each other and the extendable stands are collapsed into their respective panels. In particular, FIG. 14 shows the extendable stands for both the first panel 104 and the second panel 106 (wherein the extendable stand 112 thereof is labeled) in a closed or retracted (collapsed) position. FIG. 16 shows both of the extendable stands in an open or extended position, while FIG. 15 shows the extended stands in an open display position, wherein the extended stands are spread away from each other and a middle support bar is positioned therebetween. The middle support bar provides stability for the extendable stands/display board in general.

Because of the extendable stand structure, configuration, pivoting manner, and/or placement thereof, the display board 100 may be used with either end up or down. Additionally, the extendable stand structure allows the display board to be in varying degrees of angles. Further, the display board is height adjustable.

Figure 17:
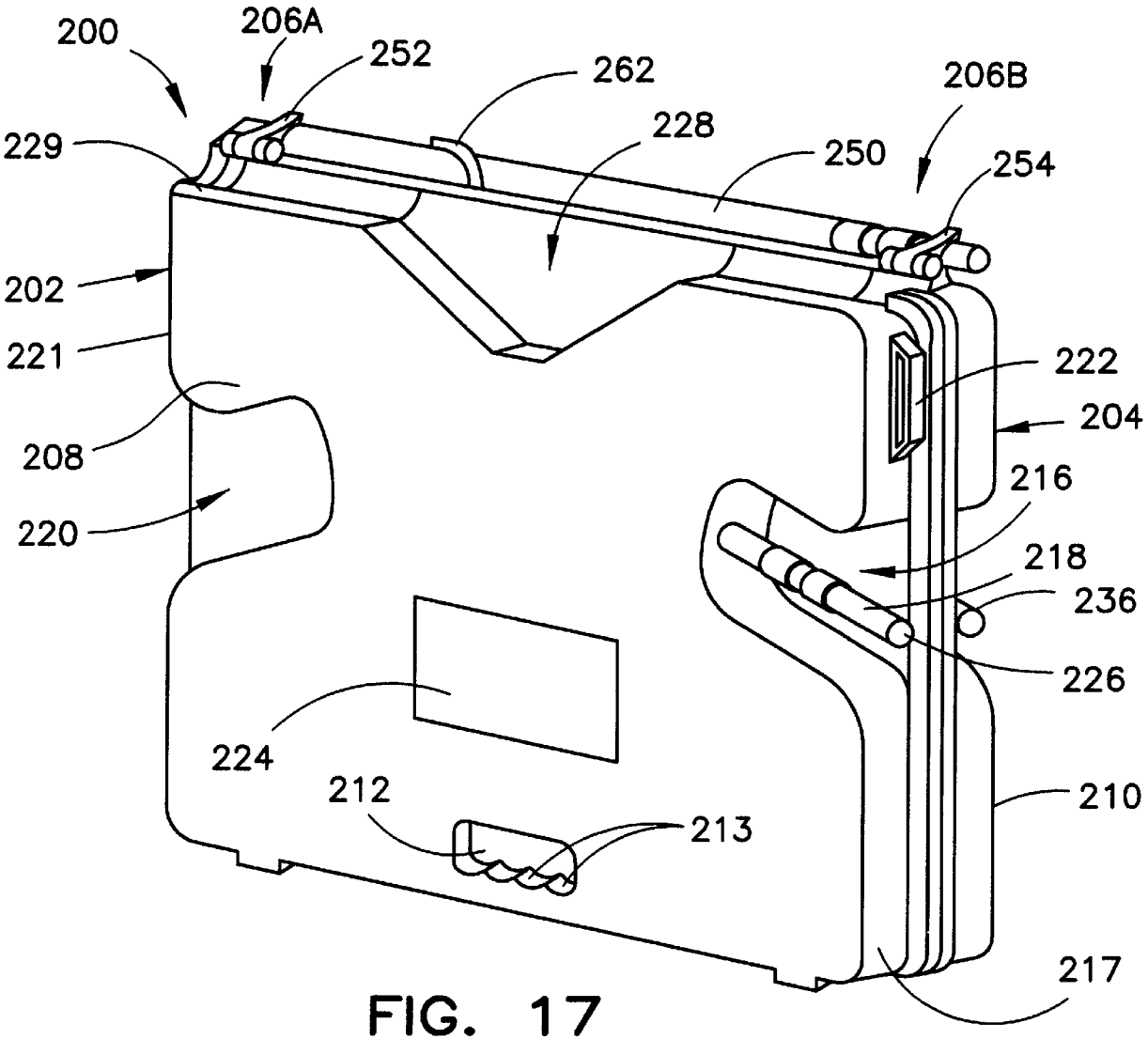
FIG. 17 is a perspective view of another embodiment of a portable display board in accordance with the principles of the subject invention.
Figure 19:
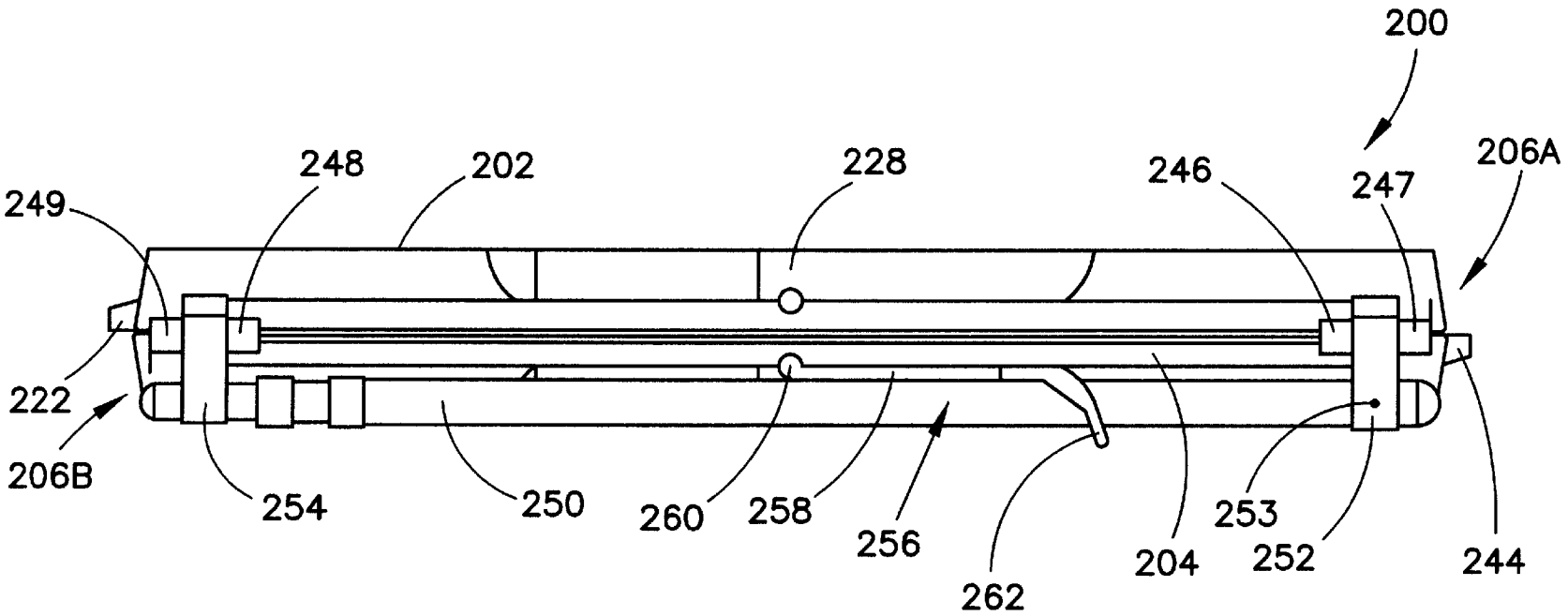
FIG. 19 is a top view of the portable display board of FIG. 17.
Figure 20:
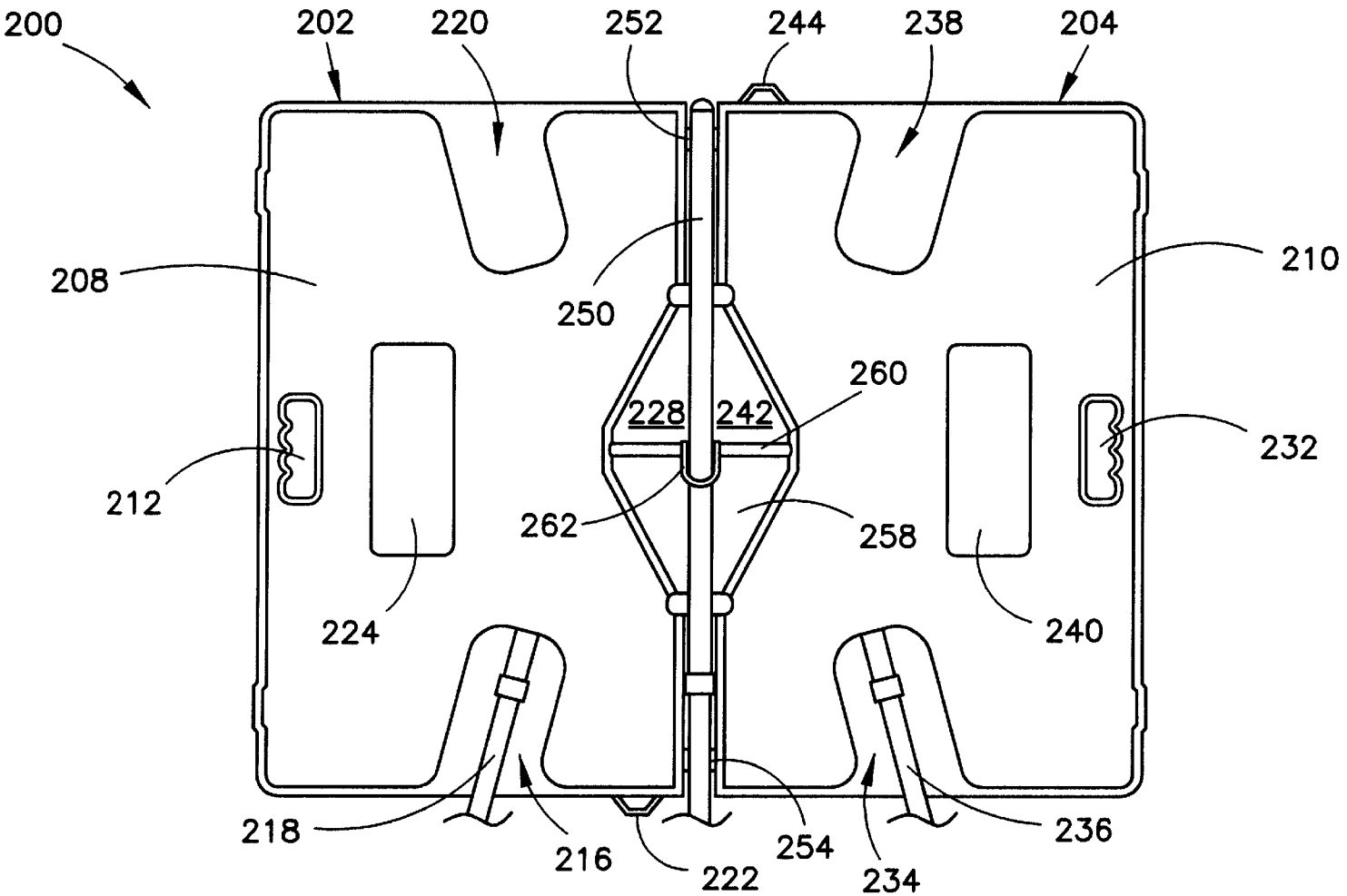
FIG. 20 is a rear view of the portable display board of FIG. 17 in an open position.

Referring now to FIG. 17, there is depicted another embodiment of a portable display or white board generally designated 200. The white board 200 essentially has the same features of and functions in essentially the same manner as the display boards previously discussed. Variations in the features and/or function of the white board 200 compared to the previously discussed display boards. The white board 200 has a first panel 202 that is coupled to a second panel 204 such that the first and second panels pivot or swing relative to one another. It should be appreciated that the panels 202 and 204 are arbitrarily labeled "first" and "second." In one form, the first and second panels 202 and 204 are coupled to one another via a first hinge structure 206A and a second hinge structure 206B and are discussed further with respect to FIG. 18. The hinge structures 206A and 206B allow the panels 202 and 204 to swing or pivot relative to one another such that the panels 202 and 204 may be situated in a closed position as depicted in FIG. 17 and in an open position as depicted in FIGS. 19 and 20, for example. When in a closed position, the panels 202 and 204 are adjacent and parallel to one another (arbitrarily at a 0° position). When in an open position, the panels 202 and 204 are co-planar to one another (arbitrarily at a 180° position).

The first panel 202 is formed of a suitable plastic and is preferably, but not necessarily, made via injection molding. The first panel 202 has a non-presentation or outer side 208 that may be textured (as shown) or that may not be textured. Such texturing may be for aesthetics, to provide a non-skid surface, or the like. The non-presentation side 208 has an integrally formed handle area 212. Particularly, a handle recess or concavity 212 is formed in the non-presentation side 208, with the recess or concavity 212 preferably, but not necessarily, having multiple (typically four) finger slots 213. The handle area 212 is situated proximate a side opposite the hinge structures 206A and 206B and is used to allow one to grasp the display board 200 for carrying, typically when the panels 202 and 204 are in the closed position.

The non-presentation side 208 also has an integrally formed leg recess or concavity 216 that extends from one side 217 of the panel 202 in towards the center of the panel 202. The leg recess 216 is angled or skew relative to a perpendicular taken from the side 217. Particularly, the leg recess 216 is angled upwardly with respect to the perpendicular. A telescoping leg 218 is situated in the leg recess 216. Particularly, the telescoping leg 218 extends from inside of the panel 202 (i.e. the telescoping leg 218 being injection molded into the panel 202) and into the leg recess 216 at the same angle as the leg recess 216. The telescoping leg 218 is shown in a retracted position. When the telescoping leg 218 is in a retracted position, the end 226 of the telescoping leg 218 does not extend beyond the plane of the side 217. The telescoping leg 218 is, of course, extendable (length adjustable) in a manner known in the art such that the end 226 thereof extends well beyond the side 217. When extended, the telescoping leg 218 forms one leg of a tripod stand of the display board 200. The length of the telescoping leg 218 is adjustable over an infinite range from a fully extended position to a fully retracted position.

While not necessary, the non-presentation side may include an integrally formed another leg recess or concavity 220 that extends from one side 221 of the panel 202 in towards the center of the panel 202. The leg recess 220 is angled or skew relative to a perpendicular taken from the side 221. Particularly, the leg recess 220 is angled upwardly with respect to the perpendicular. While there is no telescoping leg situated in the leg recess 220, the panel 202 is preferably formed with the leg recess 220 in order for the same mold to be used for the first and second panels 202 and 204.

The first panel 202 also includes a blank area 224 onto which may be molded a name, nameplate or the like. The blank area 224 is preferably not textured. The first panel 202 further includes a support recess or concavity 228 extending from the side 229 proximate the hinge structures 206A and 206B. Moreover, the first panel 202 includes an ear structure 222 that provides a place to clip a strap or the like (not shown) for carrying the white board 200.

Figure 18:
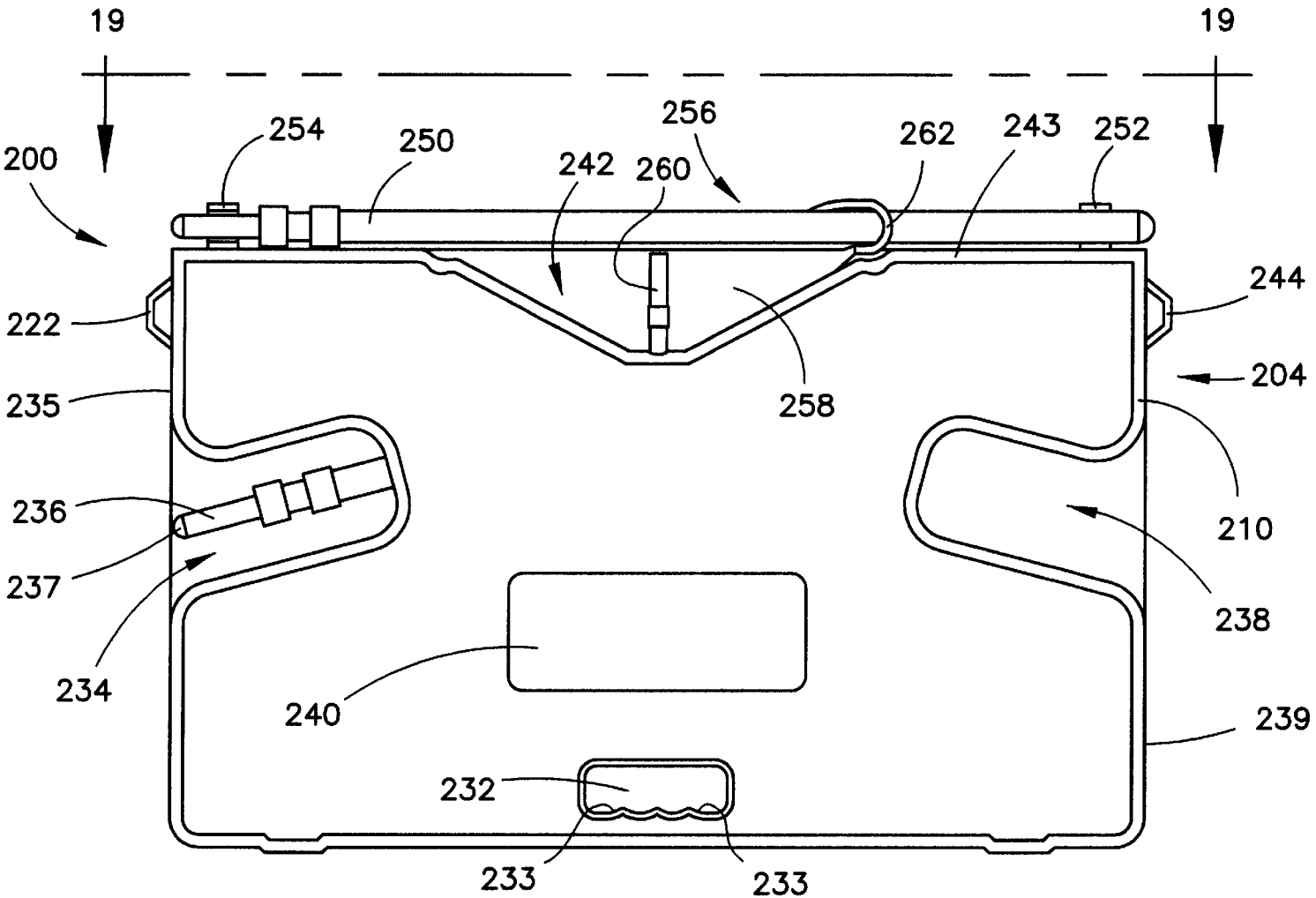
FIG. 18 is a side view of the portable display board of FIG. 17.

With reference to FIG. 18, the second panel 204 is formed of a suitable plastic and is preferably, but not necessarily, made via injection molding. The second panel 204 has a non-presentation or outer side 210 that may be textured (as shown) or that may not be textured. Such texturing may be for aesthetics, to provide a non-skid surface, or the like. The non-presentation side 210 has an integrally formed handle area 232. Particularly, a handle recess or concavity 232 is formed in the non-presentation side 210, with the recess or concavity 232 preferably, but not necessarily, having multiple (typically four) finger slots 233. The handle area 232 is situated proximate a side opposite the hinge structures 206A and 206B and is used to allow one to grasp the display board 200 for carrying, typically when the panels 202 and 204 are in the closed position.

The non-presentation side 210 also has an integrally formed leg recess or concavity 234 that extends from one side 235 of the panel 204 in towards the center of the panel 204. The leg recess 234 is angled or skew relative to a perpendicular taken from the side 235. Particularly, the leg recess 234 is angled upwardly with respect to the perpendicular. A telescoping leg 236 is situated in the leg recess 235. Particularly, the telescoping leg 236 extends from inside of the panel 202 (i.e. the telescoping leg 236 being injection molded into the panel 202) and into the leg recess 234 at the same angle as the leg recess 234. The telescoping leg 236 is shown in a retracted position. When the telescoping leg 236 is in a retracted position, the end 237 of the telescoping leg 235 does not extend beyond the plane of the side 235. The telescoping leg 235 is, of course, extendable (length adjustable) in a manner known in the art such that the end 237 thereof extends well beyond the side 235. When extended, the telescoping leg 236 forms one leg of a tripod stand of the display board 200. The length of the telescoping leg 236 is adjustable over an infinite range from a fully extended position to a fully retracted position.

While not necessary, the non-presentation side may include another integrally formed leg recess or concavity 238 that extends from one side 239 of the panel 204 in towards the center of the panel 204. The leg recess 239 is angled or skew relative to a perpendicular taken from the side 239. Particularly, the leg recess 238 is angled upwardly with respect to the perpendicular. While there is no telescoping leg situated in the leg recess 238, the panel 204 is preferably formed with the leg recess 238 in order for the same mold to be used for the first and second panels 202 and 204.

The second panel 204 also includes a blank area 240 onto which may be molded a name, nameplate or the like. The blank area 240 is preferably not textured. The second panel 204 further includes a support recess or concavity 242 extending from the side 243 proximate the hinge structures 206A and 206B Moreover, the second panel 204 includes an ear structure 244 that provides a place to clip a strap or the like (not shown) for carrying the white board 200.

Referring now to FIG. 19, there is depicted a top view of the white board 200. The first hinge structure 206A includes a first hinge portion 246 that is integral with the second panel 204, and a second hinge portion 247 that is integral with the first panel 202. A pin or the like (not shown) extends through the first and second hinge portions 246, 247 of the first hinge structure 206A such that the first and second panels 202, 204 are pivotally attached to one another and are positionable relative to one another in the manner set forth herein.

The second hinge structure 206B includes a first hinge portion 248 that is integral with the first panel 202, and a second hinge portion 249 that is integral with the second panel 204. A pin or the like (not shown) extends through the first and second hinge portions 248, 249 of the second hinge structure 206B such that the first and second panels 202, 204 are pivotally attached to one another.

Still referring to FIG. 19, the white board 200 further includes a center telescoping leg 250, that together with the telescoping legs 218 and 236 (and when extended), form a tripod or three-legged stand for the first and second panels 202, 204. The telescoping leg 250 is pivotally attached at a fixed end (non-telescoping end) thereof to the panels 202, 204 by a pivot pin 253 that extends through a leg clip 252. The leg clip 252 is pivotally attached to the hinge pin (not shown) for the hinge structure 206A. The telescoping leg 250 is releasably retained to the panels 202, 204 by another leg clip 254. The leg clip 254 is pivotally attached to the hinge pin (not shown) for the hinge structure 206B. It should be appreciated that the white board and thus the legs 218, 236 and 250 are in a stowed or closed position in FIG. 19. In an open position as discussed below, the leg 250 is released from the leg clip 254. The leg clip 252 allows the leg 250 to swing into a central position while the pivot pin 253 allows the leg 250 to pivot away from the panels 202, 204 in order to form the tripod stand for the panels 202, 204. Typically, the leg 250 may swing approximately 20° outwardly from the panels.

In order to provide stability for the center leg 250 and limit the outward travel or pivot distance of the center leg 250 relative to the panels 202, 204, the white board 200 includes a leg support/travel distance structure 256 that is situated in the recess 242 of the second panel 204. The leg support/travel distance structure 256 includes a body 258 shaped to be received in the recess 242. As best seen in FIG. 18, the body 258 is pivotally attached at 260 to the second panel 204 such that the body 258 is outwardly swingeable relative to the panels 202, 204. The leg support/travel distance structure 256 also includes a clip, retainer or retaining ring 262 at the end of the body 258. The leg 250 is retained by the clip 262.

Referring now to FIG. 20, the white board 200 is shown in the open position showing the non-presentation sides 208, 210 of the first and second panels 202, 204 respectively. In FIG. 20, the outside legs 218 and 234 (of the tripod stand for the panels 202 and 204 comprising the outside legs 218, 234 and the center leg 250) have been extended beyond the respective recesses 216 and 234 in order to elevate the panels 202 and 204. The extended length of each leg 218, 234 is a matter of choice. Each length, however, is preferably the same. The center leg 250 has also been extended beyond the panels 202, 204, but not yet extended outwardly with respect to the panels 202, 204.

Figure 21:
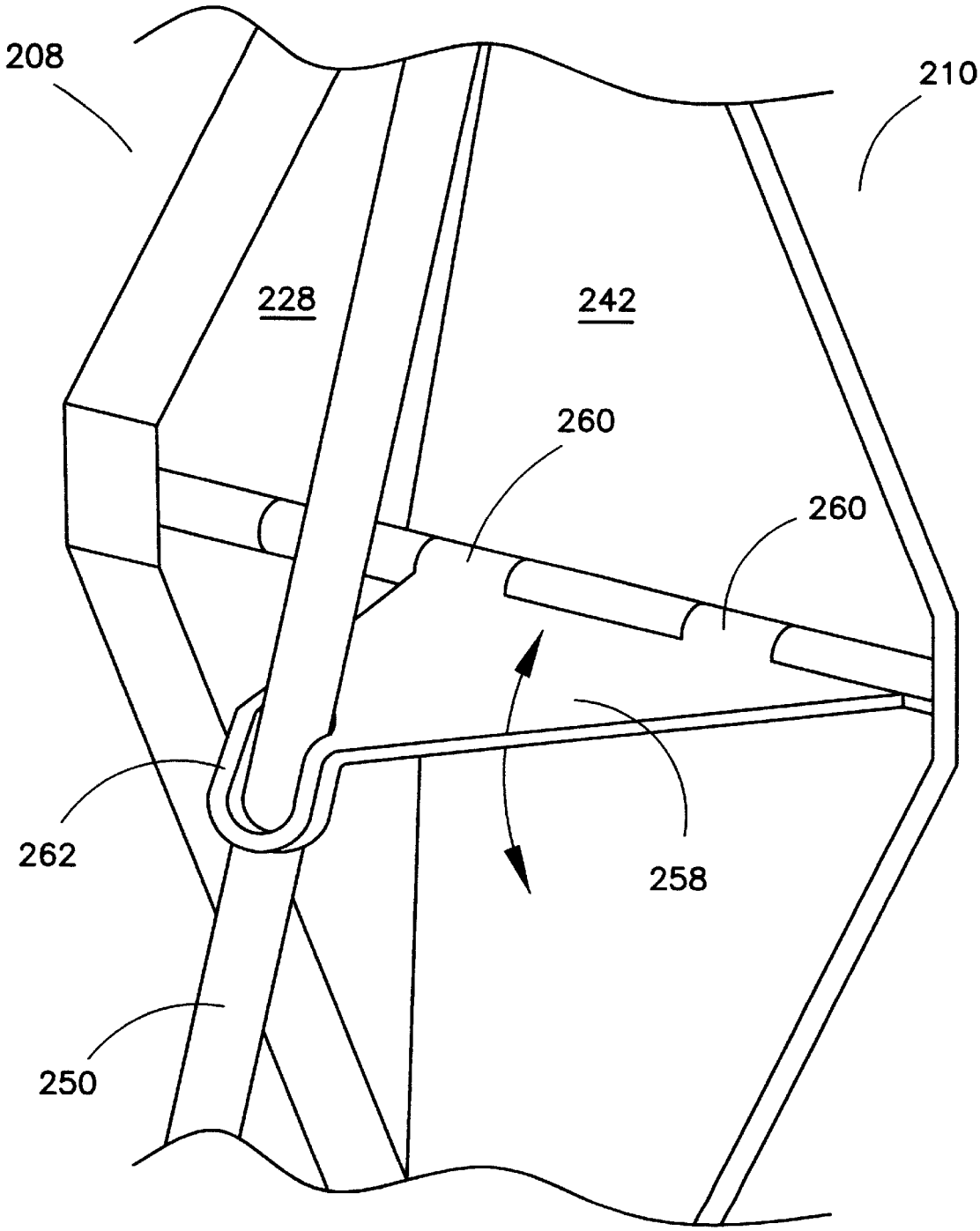
FIG. 21 is an enlarged perspective view of a portion of the portable display board of FIG. 17 particularly showing the integral center leg stabilizer.

As best seen in FIG. 21, the center leg 250 has been pivoted outwardly with respect to the first and second panels 202 and 204 in order to form the tripod stand. As the leg 250 is pivoted outwardly, the leg 250 pushes against the clip 262 which pulls against the body 258. In response, the body 258 pivots about the pivots 260 that are attached to the panel 204. The length that the leg 250 may travel away (outwardly) from the panels 202, 204 depends on the length of the body 258 and clip 262. The leg support/travel distance structure 256 thus retains the leg 250 from spreading out too far from the panels 202, 204 which would result in the collapse of the display board.

Figure 22:
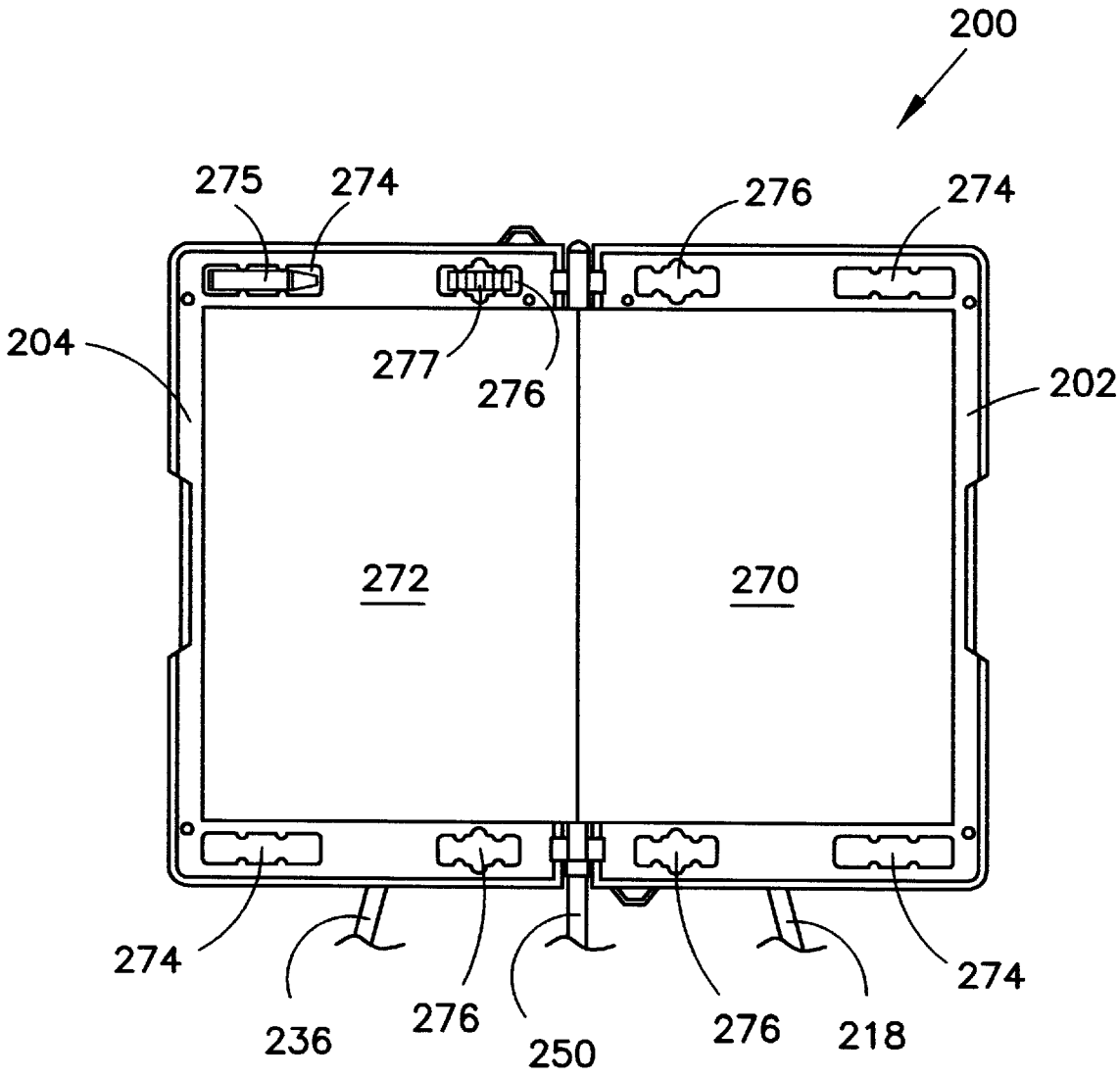
FIG. 22 is a front view of the portable display board of FIG. 17 in an open position.

In FIG. 22, a front view of the portable white board 200 is shown, the white board 200 being in an open or presentation position. The panel 202 further has a presentation side having a white board portion 270. The panel 204 further has a presentation side having a white board portion 272. When the board 200 is in the open position, the two white board portions 270 and 272 form a continuous white board. Furthermore, each panel 202 and 204 includes a plurality of white board marker recesses, concavities or the like 274 that are shaped and/or configured to releasably retain a white board marker such as the white board marker 275. Moreover, each panel 202 and 204 includes a plurality of white board eraser recesses, concavities or the like 276 that are shaped and/or configured to releasably retain a white board eraser such as the white board eraser 277. The plurality of white board marker recesses and white board eraser recesses are formed around the periphery of the white board portions 270, 272. The recesses 274 and 276 allow the storage of markers and erasers when the white board 200 is stowed (i.e. in a closed position) and the immediate access by a user when the white board 200 is open (as shown).

Figure 23:
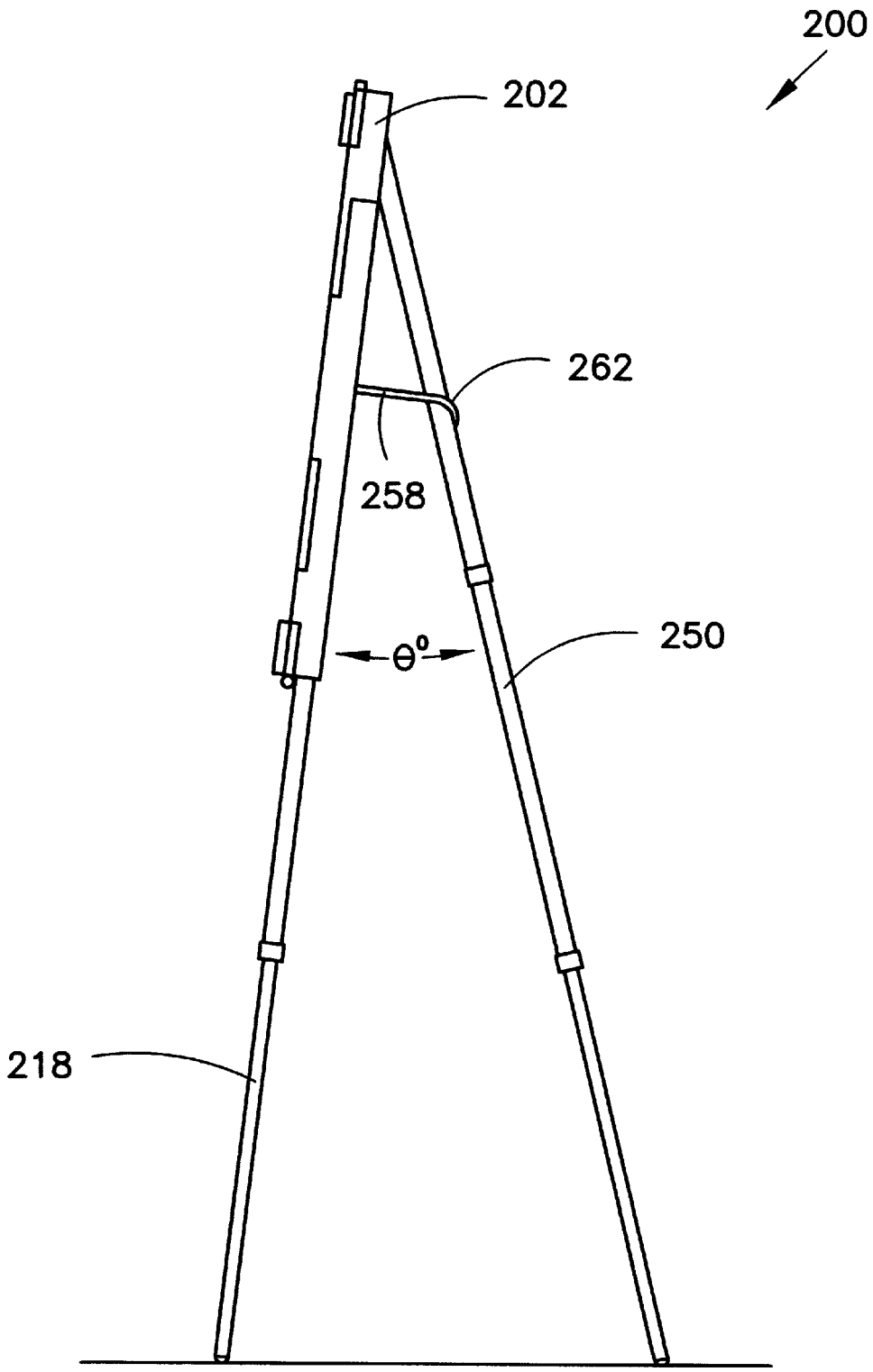
FIG. 23 is a side view of the portable display board in an open and extended position.

Referring to FIG. 23, a side view of the present portable white board 200 in an open position is depicted. Particularly, FIG. 23 depicts the white board 200 with the panels 202 and 204 in an open position and the legs 218, 236 and 250 extended and spread to form a tripod stand. The center leg 250 is at an angle θ from the panels. Preferably, but not necessarily, the angle θ is approximately 20°.

While this invention has been described as having various preferred designs and/or configurations, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the claims.

What is claimed is:

1. A portable writing board structure comprising:

a first injection molded plastic panel having a first side with a first writing surface portion and a second side opposite said first side;

a second injection molded plastic panel having a first side with a second writing surface portion and a second side opposite said first side;

said first and second injection molded plastic panels pivotally coupled to one another such that said first and second panels define a closed position and an open position, said open position situating said first and second writing surface portions in a co-planar relationship to provide a continuous writing surface, and said closed position situating said first and second writing surface portions in a parallel relationship;

a first telescoping leg having an end section integrally molded into said first panel such that a remaining telescoping section of the first telescoping leg extends in a first concavity formed in said second side of said first panel;

a second telescoping leg having an end section integrally molded into said second panel such that a remaining telescoping section of the second telescoping leg extends into a second concavity formed in said second side of said second panel; and a center telescoping leg pivotally attached at one end to one of said first and second panels;

said first, second and center telescoping legs forming a height-adjustable tripod stand for said first and second panels when said first and second panels are in said open position.

2. The writing board structure of claim 1, wherein said first and second writing surfaces are dry-erase board surfaces.

3. The writing board structure of claim 1, wherein said first side of said first panel includes a first recess configured to releasably retain a writing utensil and a second recess configured to releasably retain an eraser.

4. The writing board structure of claim 3, wherein said first and second recesses are provided at a peripheral edge of said first side of said first panel.

5. The writing board structure of claim 3, wherein said first side of said second panel includes a third recess configured to releasably retain a writing utensil and a fourth recess configured to releasably retain an eraser.

6. The writing board structure of claim 1, wherein:

said remaining telescoping section of the first telescoping leg remains within said first concavity formed in said second side of said first panel when said first telescoping leg is in a fully retracted position; and said remaining telescoping section of the second telescoping leg remains within said first concavity formed in said second side of said first panel when said first telescoping leg is in a fully retracted position; and said remaining telescoping section of the second telescoping leg remains within said second concavity formed in said second side of said second panel when said second telescoping leg is in a fully retracted position.

7. The writing board of claim 6, wherein said center telescoping leg is situated between said first and second panels and has a retracted position such that said center telescoping leg remains within boundaries of the first and second panels.

8. A portable writing board structure comprising:

a first injection molded plastic panel having a first side with a first writing surface portion and a second side opposite said first side;

a second injection molded plastic panel having a first side with a second writing surface portion and a second side opposite said first side;

said first and second injection molded plastic panels pivotally coupled to one another such that said first and second panels define a closed position and an open position, said open position situating said first and second writing surface portions in a co-planar relationship to provide a continuous writing surface, and said closed position situating said first and second writing surface portions in a parallel relationship;

a first telescoping leg having an end section integrally molded into said first panel such that a remaining telescoping section of the first telescoping leg extends in a first concavity formed in said second side of said first panel;

a second telescoping leg having an end section integrally molded into said second panel such that a remaining telescoping section of the second telescoping leg extends into a second concavity formed in said second side of said second panel;

a center telescoping leg pivotally attached at one end to one of said first and second panels; and a leg support pivotally attached to one of said first and second panels and having a clip surrounding said center telescoping leg and operative to limit outward pivoting of said center telescoping leg;

said first, second and center telescoping legs forming a height-adjustable tripod stand for said first and second panels when said first and second panels are in said open position.

9. The writing board structure of claim 8, wherein said leg support is operative to limit outward pivoting of said center telescoping leg to approximately twenty degrees from said first and second panels when said first and second panels are in an open position.

10. The writing board structure of claim 8, wherein said leg support is situated in a support recess formed in an edge of one of said first and second panels.

11. The writing board structure of claim 8, wherein:

said remaining telescoping section of the first telescoping leg remains within said first concavity formed in said second side of said first panel when said first telescoping leg is in a fully retracted position; and said remaining telescoping section of the second telescoping leg remains within said second concavity formed in said second side of said second panel when said second telescoping leg is in a fully retracted position.

12. The writing board of claim 8, wherein said center telescoping leg is situated between said first and second panels and has a retracted position such that said center telescoping leg remains within boundaries of the first and second panels.

13. The writing board structure of claim 8, further comprising a leg clip attached to one of said first and second panels and operative to releasably retain said center telescoping leg when said first and second panels are in said closed position.

14. A portable, dry erase presentation structure comprising:

a first injection molded plastic panel having a first side with a first dry erase writing surface portion and a second side opposite said first side;

a second injection molded plastic panel having a first side with a second dry erase writing surface portion and a second side opposite said first side;

said first and second injection molded plastic panels pivotally coupled to one another such that said first and second panels define a closed position and an open position, said open position situating said first and second dry erase writing surface portions in a co-planar relationship to provide a continuous dry erase writing surface, and said closed position situating said first and second dry erase writing surface portions in a parallel relationship;

a center telescoping leg pivotally attached at one end to one of said first and second panels:

a first telescoping leg having an end section integrally molded into said first panel at a first angle relative to a longitudinal axis defined by said center telescoping leg when said center telescoping leg is in a retracted position and such that a remaining telescoping section of the first telescoping leg extends in a first concavity formed in said second side of said first panel;

a second telescoping leg having an end section integrally molded into said second panel at a second angle relative to said longitudinal axis of said center telescoping leg when said center telescoping leg is in a retracted position and such that a remaining telescoping section of the second telescoping leg extends into a second concavity formed in said second side of said second panel; and a leg support pivotally attached to one of said first and second panels and having a clip surrounding said center telescoping leg and operative to limit outward pivoting of said center telescoping leg;

said first, second and center telescoping legs forming a height-adjustable tripod stand for said first and second panels when said first and second panels are in said open position.

15. The portable, dry erase presentation structure of claim 14, wherein said first and second angles are outwardly with respect to said longitudinal axis of said center telescoping leg.

16. The portable, dry erase presentation structure of claim 14, wherein said first side of said first panel includes a first recess configured to releasably retain a writing utensil and a second recess configured to releasably retain an eraser.

17. The portable, dry erase presentation structure of claim 16, wherein said first and second recesses are provided at a peripheral edge of said first side of said first panel.

18. The portable, dry erase presentation structure of claim 16, wherein said first side of said second panel includes a third recess configured to releasably retain a writing utensil and a fourth recess configured to releasably retain an eraser.

* * * * *